US005115949A

United States Patent [19]

Rosenthal

[11] Patent Number: 5,115,949

[45] Date of Patent: May 26, 1992

[54] FLEXIBLE LIQUID CONTAINER WITH A SLIDING CLOSURE CAP

[75] Inventor: Karl-Heinz Rosenthal, Reichsdorf, Fed. Rep. of Germany

[73] Assignee: Bielsteiner Verschlusstechnik GmbH, Gummerbach, Fed. Rep. of Germany

[21] Appl. No.: 498,336

[22] Filed: Mar. 23, 1990

[30] Foreign Application Priority Data

Apr. 6, 1989 [DE] Fed. Rep. of Germany ..... 3911183

[51] Int. Cl.[5] ..... B65D 37/00; B67D 31/00

[52] U.S. Cl. ..... 222/211; 222/212; 222/484; 222/512; 222/531; 222/532; 222/537

[58] Field of Search ..... 222/211, 212, 484, 482, 222/481, 531, 532, 537, 540, 545, 546, 561

[56] References Cited

U.S. PATENT DOCUMENTS

| | | | |
|---|---|---|---|
| 1,847,703 | 3/1932 | Ullman | 222/484 |
| 2,050,809 | 8/1936 | Ruetz | 222/512 X |
| 2,334,035 | 11/1943 | Robertson | 222/537 X |
| 2,917,210 | 12/1959 | Libit | 222/512 |
| 2,918,200 | 12/1959 | Libit | 222/512 |
| 2,969,167 | 1/1961 | Libit | 222/512 |
| 2,971,680 | 2/1961 | Wilson et al. | 222/484 X |
| 3,146,913 | 9/1964 | Nagai | 222/537 X |
| 3,655,102 | 4/1972 | Moran | 222/484 |
| 3,677,445 | 7/1972 | Linkletter | 222/532 X |
| 4,057,177 | 11/1977 | Laauwe . | |
| 5,054,634 | 10/1991 | Margotteau | 222/532 |

FOREIGN PATENT DOCUMENTS

| | | |
|---|---|---|
| 2233248 | 1/1975 | France . |
| 1462508 | 1/1977 | United Kingdom . |

*Primary Examiner*—Kevin P. Shaver
*Attorney, Agent, or Firm*—Dressler, Goldsmith, Shore, Sutker & Milnamow, Ltd.

[57] ABSTRACT

The invention relates to a one-piece plastic cap, the lower part of which, which can be attached to a container opening, is provided with a top wall in which a passage opening is provided, the lower side of which is joined via a dip tube to the container. The top wall is, furthermore, provided with a hole diaphragm which, in the closed position of the upper part, is closed by a sealing spike protruding from its lower side and, in the open position of the upper part, interacts with a valve spike projecting from its lower side which is dimensioned shorter relative to the sealing spike so that, when pressure is exerted on the container, the ventilation valve is closed. A pre-tensioning device of the upper part interacts with the lower part so that, in the closed position of the upper part, a discharge channel in the upper part is pressed with elastic pre-tension sealingly against the top wall and, in the open position of the upper part, sealingly against the edge of the passage opening. By the compression of the liquid container, the cap makes it possible for liquid to be dispensed and, after it has been released, for air to be taken in without the discharge channel of the cap being completely emptied. The cap is secure during transport when closed.

13 Claims, 6 Drawing Sheets

FLEXIBLE LIQUID CONTAINER WITH A SLIDING CLOSURE CAP

TECHNICAL FIELD

The invention relates to a flexible liquid container.

BACKGROUND OF THE INVENTION AND TECHNICAL PROBLEMS POSED BY THE PRIOR ART

The flexible liquid containers are, as a rule, made from plastic and enable the flowable product contained in them to be dispensed by it being possible for the wall of the container to be compressed by hand and, as a result of the ensuing reduction in the internal volume of the container, the flowable product situated inside it to be dispensed through the opened cap. Flexible containers are, as a rule, designed in such a way that their wall automatically resumes the original position when the person using it ceases to exert pressure on the container wall or lets go of the container and puts it down. The wall of the container naturally only resumes the original starting position when atmospheric air can simultaneously enter inside the container.

This assumes that the cap must remain open for a certain period even after the container liquid has been dispensed. Consequently, it is often forgotten to close the container because the person using it has in the meantime turned to other activities. Depending on the nature of the contents of the container, residual liquid consequently dries out in the dispensing opening of the cap, and under some circumstances the container and its contents can thus become permanently unusable. In addition, liquid contained in the container can in most cases only be dispensed when the container is held upside down so that the contents of the container are situated directly above the cap and can be dispensed by pressure on the container wall. In this case, however, exact measurement of the liquid to be dispensed is often difficult because it is not always possible to avoid dripping.

It is an object of the invention to improve the above-mentioned container of known type in such a way that a flexible liquid container equipped with such a cap in an essentially upright position can be compressed by hand in order to dispense liquid and, after being released, can immediately take in air without the discharge channel of the cap being completely emptied in order to ensure immediate dispensing of the contents of the container upon subsequent emptying. The cap should, furthermore, be secure during transport when closed.

SUMMARY OF THE INVENTION

The present invention provides a sliding closure cap for a flexible liquid container which has a neck defining and surrounding an opening. The cap has a lower part for being mounted to the container neck over the opening. The cap lower part has a top wall defining a passage opening for the liquid in the container. A dip tube is mounted to the cap lower part top wall around the passage opening and extends substantially to the base of the container.

The cap has an upper part which is provided with a closing member for the passage opening. The cap upper part can move between a closed position and open position.

The cap lower part top wall has a ventilation valve that includes a diaphragm defining a hole. The cap upper part has a lower side and a sealing spike protruding from the lower side for closing the diaphragm hole when the cap upper part is in the closed position.

The cap upper part further includes a valve spike that projects from the lower side of the cap upper part and that is generally parallel to, but shorter than, the sealing spike for interacting with the diaphragm hole when the cap upper part is in the open position.

The diaphragm is movable away from the valve spike by pressure outside of the container to permit venting of air through the hole into the container when the container internal pressure is less than the outside pressure. The diaphragm is movable to seal against the valve spike when the container is squeezed to dispense the liquid.

The cap upper part further includes a discharge channel with an inlet opening from which the liquid in the container can be discharged. The cap also includes a pre-tensioning device having means for pressing the discharge channel to seal the inlet opening closed against an upper side of the cap top wall when the cap upper part is in the closed position. The pre-tensioning device pressing means also functions for pressing the discharge channel against the cap top wall to establish sealed communication between the inlet opening and the passage opening of the top wall when the cap upper part is in the open position.

In a preferred embodiment, the pre-tensioning device includes side walls on the cap lower part and includes engaging spring elements on the cap upper part. Each side wall defines a longitudinal slot which is closed at each end, which has an upper edge, and which is adapted to receive one of the spring elements. Each spring element has an end for being guided along the upper edge of one of the slots. The cap upper part also defines a lower edge which is held by the pre-tensioning device so that it is spaced from the cap lower part when the cap upper part is in both the closed and open positions.

A lifting device on the top wall of the lower part enables the upper part to move perfectly and free of wear between its closed and open position, relative to the lower part, interacting with a pre-tensioning device.

Since the lower part is provided with a guide groove for the longitudinally displaceable upper part, it is ensured that the cap is given an aesthetically pleasing shape and that the upper part is guided securely in the lower part.

The fitting of the pre-tensioning device with spring elements attached to the outer side of side cheeks of the upper part, enables the pre-tensioning device to be formed integrally with the cap in one working step. The lifting device can also be produced integrally with the cap, lifting lugs provided on the top wall enabling an appreciable catch action and fastening of the upper part in its closed position and open position.

As a result of the discharge sleeve and sealing sleeve provided on the lower side of the upper part, which in each case lie with pre-tension on an inlet opening and with pre-tension on a residual-product leakage barrier, respectively, secure sealing of the discharge channel is on the one hand achieved for dispensing the liquid and for keeping the cap clean when closed.

Furthermore, the upper part of the cap enables the dispensing opening to be arranged radially and parallel to the axis of the top wall or arranged pointing downwards.

The special connection between upper part and lower part by a link provided with hinges ensures that the upper part is captive, but, in particular, that the cap is produced as a single unit. Moreover, a particularly advantageous and aesthetic overall impression of the cap is consequently achieved, both in its closed and in its open position.

BRIEF DESCRIPTION OF THE DRAWINGS

The invention is described in more detail below with reference to the diagrammatic drawing of exemplary embodiments in which.

DESCRIPTION OF THE PREFERRED EMBODIMENTS

Figure 1:
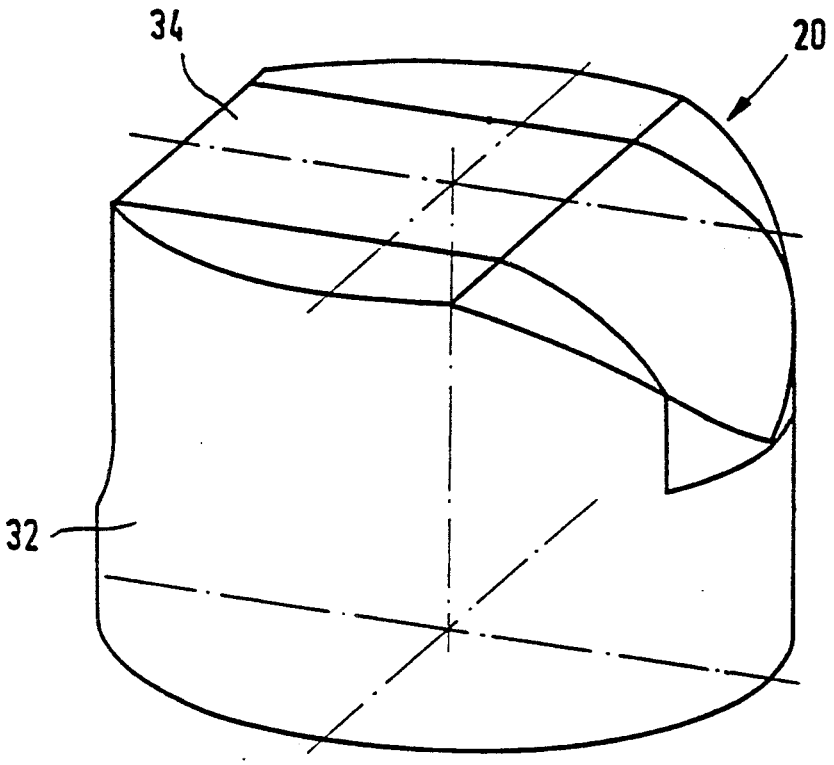
FIG. 1 shows a diagrammatic representation of a cap according to the invention in the closed position.
Figure 2:
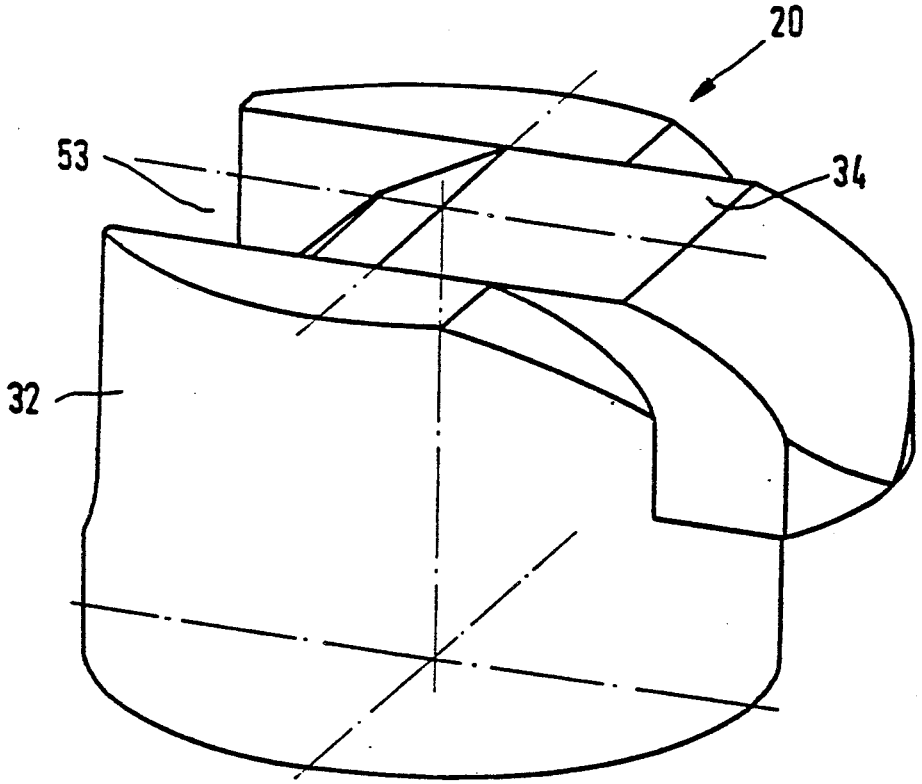
FIG. 2 shows the cap in FIG. 1 in the open position.

A cap 20 produced completely from plastic is diagrammatically represented in FIGS. 1 and 2 in the closed position (FIG. 1) and in the open position (FIG. 2). The cap 20 consists of a lower cap part 32 and an upper cap part 34. A guide groove 53, in which the upper cap part 34 is mounted, transverse to the central longitudinal axis of the cap, so as to be capable of being displaced backwards and forwards between the closed position shown in FIG. 1 and the open position in FIG. 2, extends diametrically through the lower cap part 32. FIG. 2 shows that the outer upper surface of the upper cap part 34 and of the lower cap part 32 close flush with each other in the closed position of the cap so that the cap has an attractive external shape.

Figure 5:
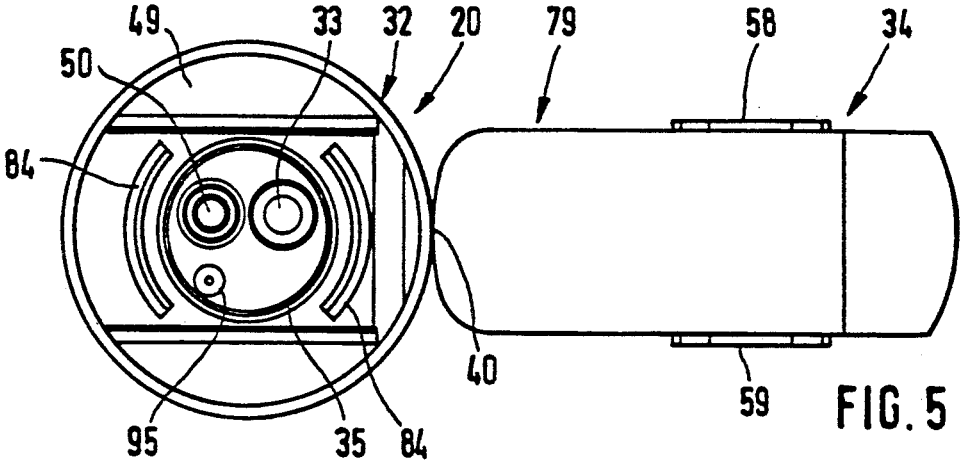
FIG. 5 shows a view from below of FIG. 3 with the lower side of the lower part and the upper side of the upper part.
Figure 4:
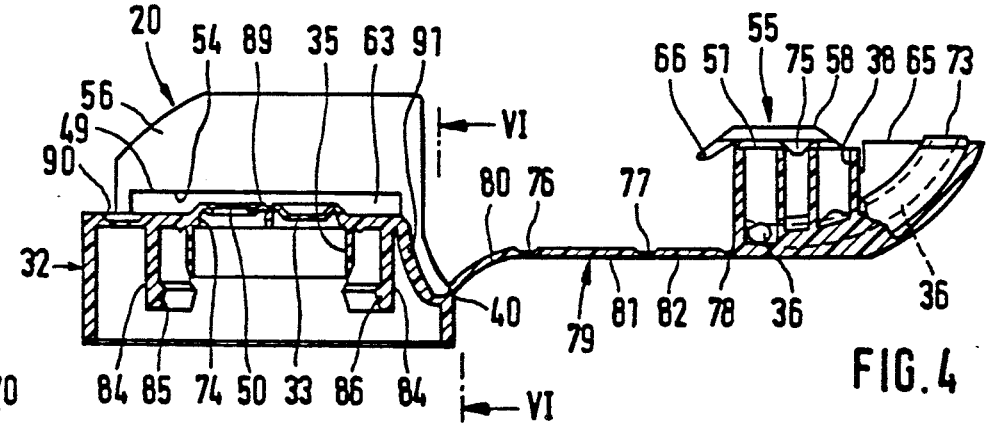
FIG. 4 shows a longitudinal section IV—IV in FIG. 3.
Figure 3A:
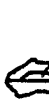
FIG. 3A shows a fragmentary, side elevational view taken generally along the view line for section III A-III A in FIG. 3.
Figure 3:
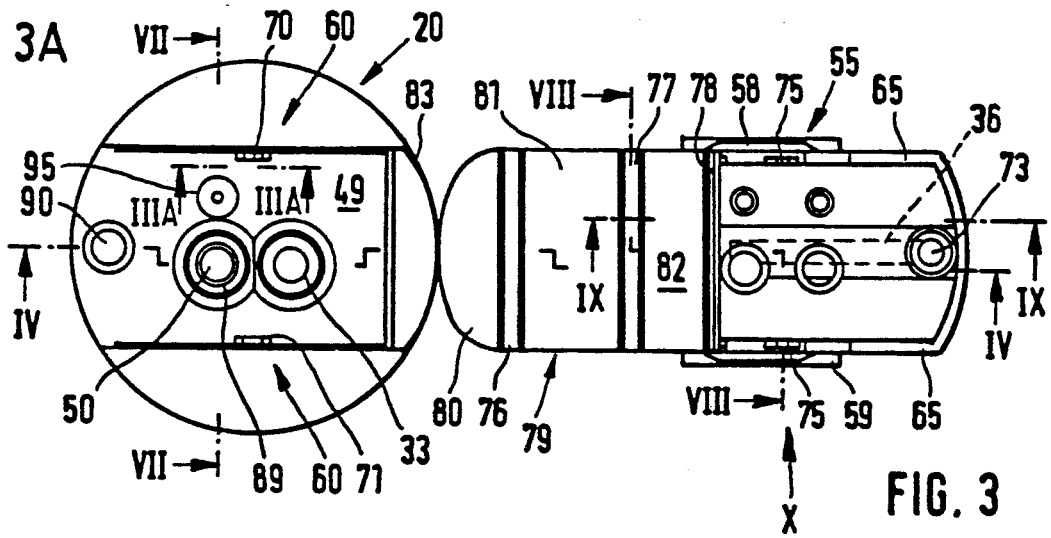
FIG. 3 shows a plan view of the lower part and the inside of the upper part of the cap.

In FIGS. 3 to 5, the cap 20 is shown in a position in which it would be removed in one piece from a corresponding plastic-injection mould. The cap 20 is provided for flexible liquid containers 30 (FIGS. 11, 13, 15 and 16), preferably made from plastic which can be emptied by exerting pressure on the flexible container wall. The cap 20 can be designed in a manner known per se as a snap-on or threaded cap. The cap shown in FIGS. 4, 5, 11, 13, 15 and 16 has a snap-on cap in which two snap arms 84 (FIGS. 4, 5) with snap jaws 85, 86 engage the underside of an annular rim 87 with a catch action on the outside of a container neck 48 surrounding a container opening 47 and tension the lower cap part 32 tightly against the top side of the container neck 48. A cylindrical sealing cone 35 is thus provided coaxial to the snap arms 84 inside the same on the lower side of a top wall 49 of the lower cap part 32 and engages sealingly into the container opening 47 of the container neck 48. An essentially cylindrical casing 83 extends radially outside the two snap arms 84 from the outer edge of the top wall 49 of the lower cap part 32 downwards as far as the upper side of the container 30.

The top wall 49 of the lower cap part 32 is provided for the liquid in the container 30 with a passage opening 50 which is surrounded by a conical edge 89.

The upper cap part 34 is equipped with a pretensioning device 55 (FIGS. 8 to 10) which is described in more detail below. This pre-tensioning device interacts with the lower cap part 32 in such a way that, as shown in FIG. 11, in the closed position of the upper cap part 34 an inlet opening 51 of a discharge sleeve 39, which opens out into a discharge channel 36 in the upper cap part 34, is pressed sealingly with elastic pre-tension against a recessed, diaphragm-like residualproduct leakage barrier 33 of the top wall 49, and in the open position of the upper cap part 34 sealingly against the conical edge 89 of the passage opening 50 in the top wall 49 of the lower cap part 32 (FIG. 13).

The discharge sleeve 39 is arranged, in the direction of the arrow X of the opening movement of the upper cap part 34, at a small distance behind a sealing sleeve 38, parallel to the latter, and projects downwards from the lower side 72 of the upper cap part 34 for the same length as the sealing sleeve 38. In the closed position of the upper cap part 34, the sealing sleeve 38 lies sealingly with elastic pre-tension against the conical edge 89 of the passage opening 50 in the lower cap part 32 and, in the open position of the upper cap part 34, is arranged at a distance above the top wall 49 of the lower cap part 32, as shown in FIGS. 11 and 13.

Figure 13:
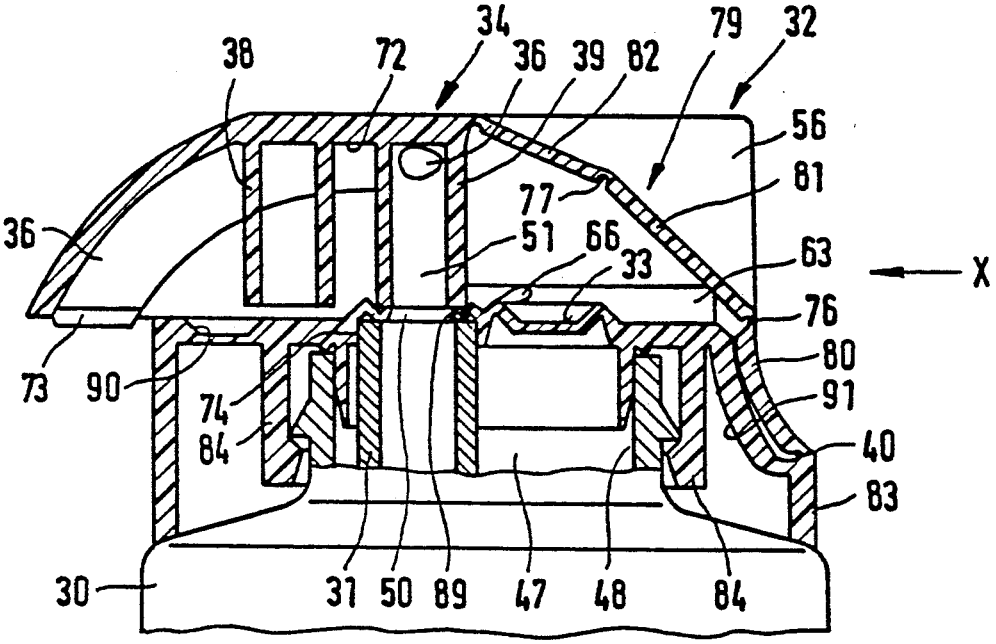
FIG. 13 shows a view in accordance with FIG. 11 but with the cap in the open position.

As shown in FIG. 13, in the opening direction x of the upper cap part 34, the discharge channel 36 runs in a curve behind the discharge sleeve 39 downwards to its dispensing opening 73 which, in the closed position of the upper cap part 34, lies tight against the sealing cup 90 on the upper side of the top wall 49 of the lower cap part 32 and, in the open position of the upper cap part 34, lies open at the bottom outside the top wall 49 (FIG. 13).

Figure 7:
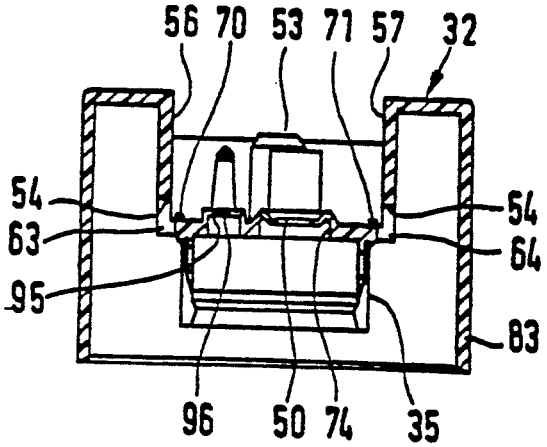
FIG. 7 shows a section VII—VII in FIG. 3.
Figure 8:
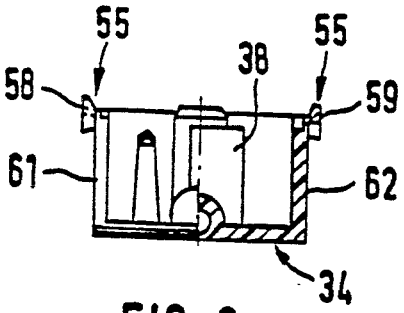
FIG. 8 shows a section VIII—VIII in FIG. 3.
Figure 9:
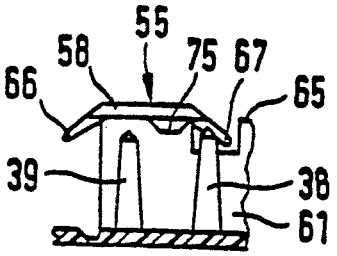
FIG. 9 shows a section IX—IX in FIG. 3.
Figure 10:
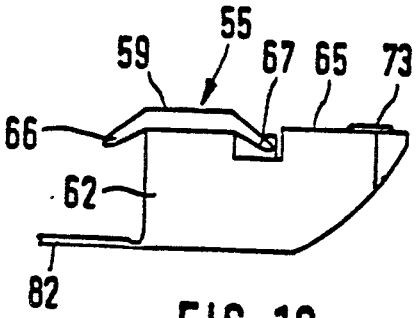
FIG. 10 shows a view following arrow X in FIG. 3.
Figure 11:
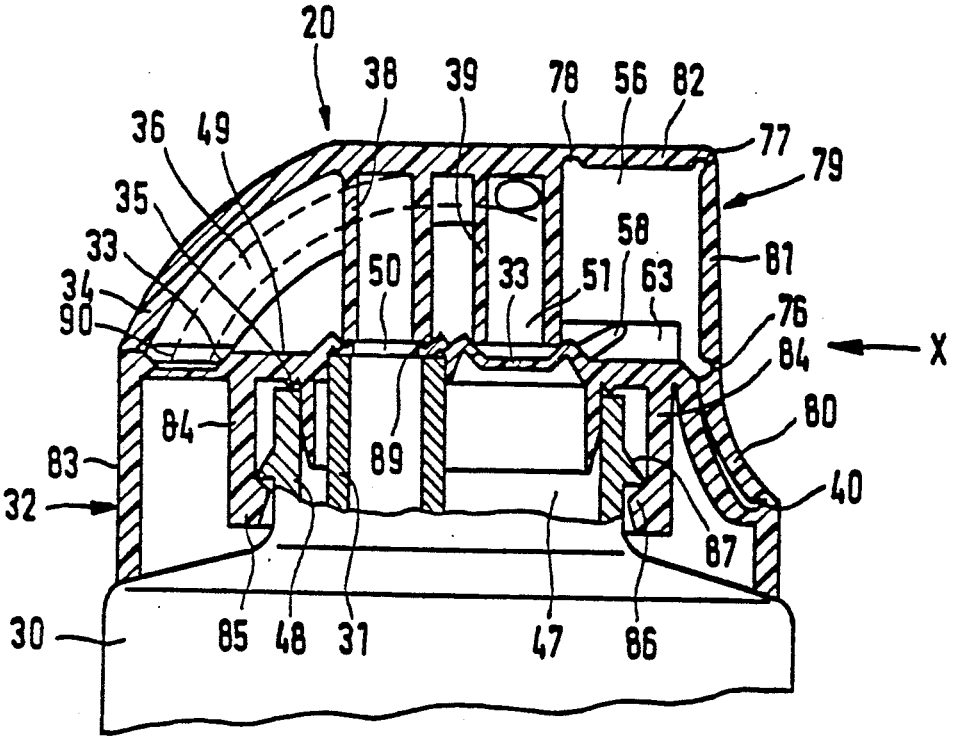
FIG. 11 shows a section corresponding to section IV—IV in FIG. 3 but with the cap in the closed position.

The pre-tensioning device 55 consists, as shown in particular in FIGS. 3 to 5 and 8 to 10, of spring elements 58, 59 which are attached to the outer side of side cheeks or walls 61, 62 of the upper cap part 34 (FIG. 8). The ski-shaped spring elements 58, 59 engage in longitudinal slots 63, 64, limited at the ends and shown in FIG. 7, in side walls 56, 57 of the guide groove 53 and are guided with their ski ends 66, 67 along an upper slot edge 54 of the two longitudinal slots 63, 64. A lower edge 65 of the side cheeks or walls 61, 62 of the upper cap part is thus held at a small distance above the top wall 49 of the lower cap part 32 both in the closed position and in the open position of the upper cap part 34. The upper cap part 34 with its parts which are important for the functioning of the cap is thus continually pressed with elastic pre-tension against the parts of the top wall 49 important for functioning, as is described in more detail below.

Figure 6:
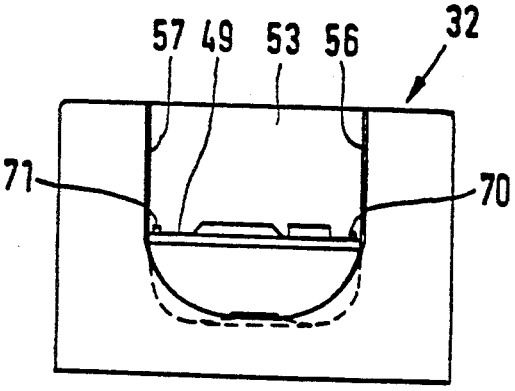
FIG. 6 shows a section VI—VI in FIG. 4.

According to FIGS. 3, 6 and 7, a lifting device 60 is provided on the upper side of the top wall 49, by means of which the upper cap part 34 can be lifted counter to the action of the pre-tensioning device 55 when it moves from the closed and open position into the open and closed position, respectively, of the top wall 49 of the lower cap part 32. The lifting device 60 consists of two lifting lugs 70, 71. The lifting lugs 70, 71 are arranged on the upper side of the top wall 49 in the region of the path of movement of the lower edge 65, which runs longitudinally, of the side cheeks 61, 62 (FIG. 8) of the upper cap part 34. The height of the lifting lugs 70, 71 is dimensioned in such a way that, when the upper cap part 34, with the lower edges 65 of the side cheeks or walls 61, 62, lies against the lifting lugs 70, 71, the lower free ends of the sealing sleeves 38, of the discharge sleeve 39, of a sealing spike 44 and of a valve spike 45 lie above the highest raised parts of the top wall 49 and the edges of the leakage barrier 33 and of the passage opening 50. The lower edge 65 of the side cheeks 61, 62 of the upper cap part 34 is provided in each case with a cut-out 75 which corresponds to the longitudinal profile of the lifting lugs 70, 71 on the top wall 49 of the lower cap part 32. The closed position of the upper cap part 34 relative to the lower cap part 32 is determined by the engagement of the lifting lugs 70, 71 into the cut-out 75 of both side cheeks 61, 62 of the upper cap part 34. The lifting lugs 70, 71 then, however, engage with such play into the cut-outs 75 of the side cheeks or walls 61, 62 that the sealing sleeve 38 seals the passage opening 50 with elastic pre-tension and the discharge channel 36 at the inlet opening 51 and dispensing opening 73 is also sealed relative to the top wall 49. For the fastening of the upper cap part 34 in the open position, the side cheeks or walls 61, 62 lie with a rear oblique surface 68 against a corresponding oblique end surface 69 of the lifting lugs 70, 71.

Figure 12:
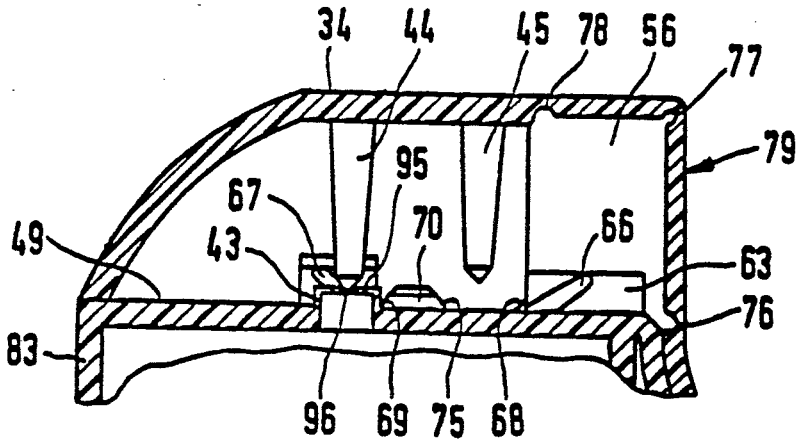
FIG. 12 shows a perpendicular longitudinal section through the ventilation valve in the top wall with views of the sealing spike on the ventilation valve and of the valve spike lying behind it.
Figure 14:
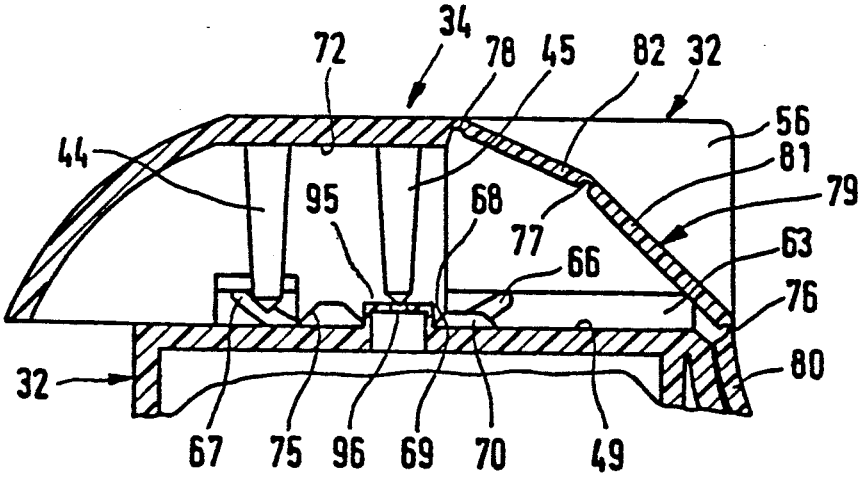
FIG. 14 shows a view corresponding to FIG. 12 but with the cap in the open position.

The top wall 49, when seen in the longitudinal direction of the upper cap part 34, is provided with a ventilation valve 43 next to the passage opening 50 (FIGS. 3, 7, 12, 14). The ventilation valve 43 consists of a diaphragm 95 which has a central hole 96. In the closed position of the upper cap part 34, the central hole 96 is closed by the sealing spike 44 which protrudes from the lower side 72 of the upper cap part 34 (FIG. 12). In the open position of the upper cap part 34, the diaphragm 95 of the ventilation valve 43 interacts with the valve spike 45 which also projects from the lower side 72 of the upper part parallel to the sealing spike 44, but is dimensioned shorter than the latter (FIG. 14). Because the valve spike 45 has a shorter dimension, the diaphragm 95 lifts off from the valve spike 45 and allows the passage of air from outside into the container when an underpressure prevails in the container. On the other hand, when the flexible container is compressed in order to dispense liquid, the diaphragm 95 is pressed and sealed against the valve spike 45. When the container is subsequently released, air is therefore pressed not only through the discharge channel 36 but also through the ventilation valve 43 into the container 30. This has the consequence that, at least for a certain period of time, some of the column of liquid remains inside a dip tube 31 so that, when pressure is subsequently exerted on the container (pumping), only a relatively small amount of air needs to be pressed out before the liquid contained in the dip tube 31 and in the container 30 is dispensed. Furthermore, a more rapid pressure compensation takes place as a result of the ventilation valve 43 so that dispensing of liquid from the container 30 can take place at relatively short intervals.

On the lower side of the top wall 49, a socket opening 74 is provided, coaxial to the passage opening 50, for the dip tube 31 which can be joined to the socket opening 74 by a press fit and/or bonding or heatsealing. The dip tube 31 extends with its lower end to the bottom of the container (not shown) so that the liquid container 30 can be completely emptied in the upright position.

As shown in FIGS. 3 to 5 and 11 to 14, the lower cap part 32 and the upper cap part 34 are joined together by a link 79 which according to FIG. 5 has a smooth outer side but is provided on the inner side with four hinges 40, 76, 77, 78 by means of which link sections 80, 81, 82 are joined. The link section 82 articulated with the upper cap part 34, as well as the central link section 81, have a width which corresponds to the upper cap part 34. The third link section 80 joined to the lower cap part 32 is joined to the casing 83 of the lower cap part 32 by the hinge 40, the width of which is dimensioned substantially smaller than the width of the upper cap part 34. This arrangement makes it possible for this third link section 80 to close flush with the outer side of the lower cap part 32 in the closed position of the upper cap part 34. This is in addition achieved by the outer end of the third link section 80, which terminates in the hinge 40 with the casing 83 of the lower cap part 32, being rounded off with a radius which approximately corresponds to the radius of the casing 83 of the lower cap part 32.

Figure 15:
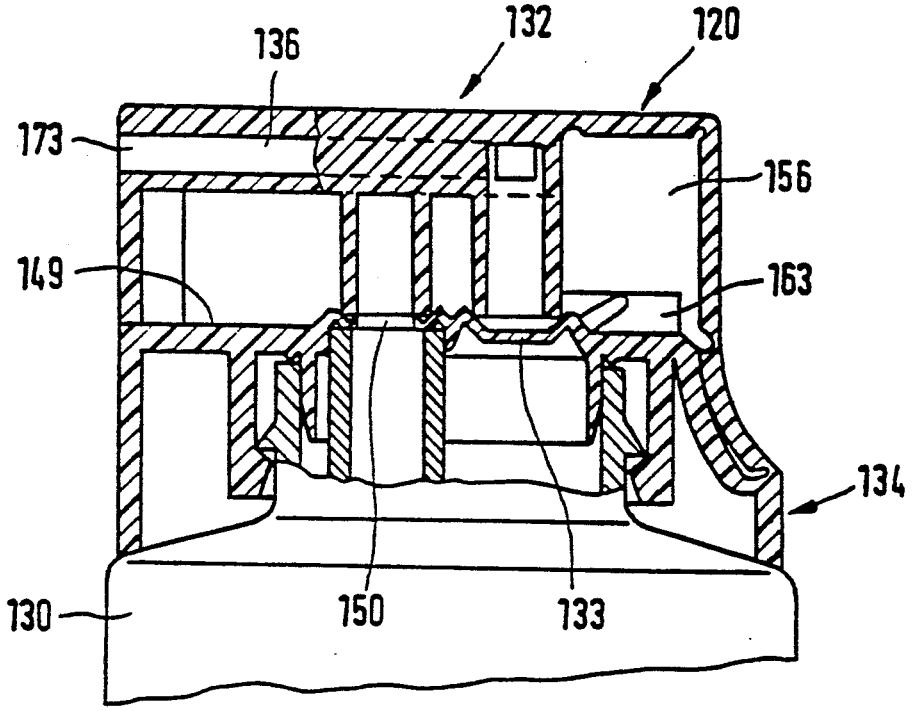
FIG. 15 shows a second embodiment of the cap according to the invention in a perpendicular longitudinal section through the passage opening and the residual-product leakage barrier in the top wall of the lower part with the upper part in the closed position.
Figure 16:
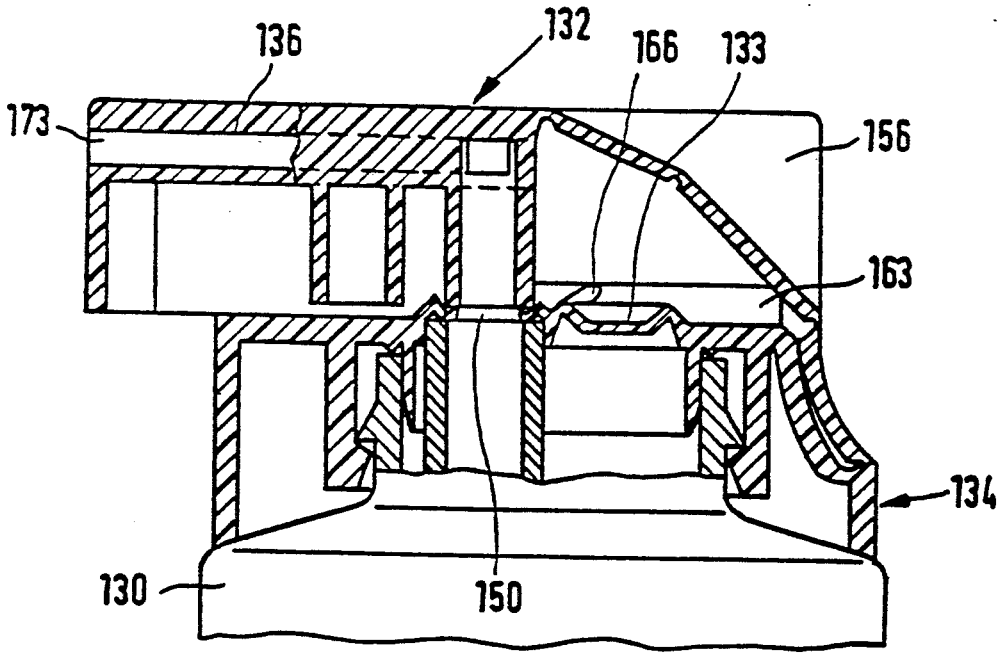
FIG. 16 shows a view of the cap in FIG. 15 in the open position.

The second embodiment shown in FIGS. 15 and 16 of a container cap 120 differs from the first embodiment only in that a discharge channel 136, parallel over its entire length to be top wall 149, opens out in a dispensing opening 173 which is thus directed radially to the main axis of a container 130 and in which a spray nozzle may optionally be inserted. The remainder of the functioning of the cap is identical to that of the first embodiment in FIGS. 1 to 14, as is readily evident from the figures in which a "1" is placed before the reference symbols for identical components or those which perform the same function.

The functioning of the container cap according to the invention can best be seen from FIGS. 11 to 14, which essentially applies also to the method of operation of the second embodiment in FIGS. 15 and 16.

The closed position of the upper cap part 34 relative to the lower cap part 32 can be seen in FIGS. 11 and 12 in two different sections. The discharge sleeve 39 is completely sealed off by the residual-product leakage barrier 33 so that liquid which has remained in the discharge channel 36 and the discharge sleeve 39, after liquid has been dispensed from the container 30, cannot leak through the discharge sleeve 39 and contaminate the lower cap part 32. Similarly, the dispensing opening 73 is completely closed by the sealing cup 90 so that any liquid remaining inside cannot leak from this end of the discharge channel 36 either and contaminate the lower cap part 32 of the cap 20. The sealing sleeve 38 closed at the upper end seals the passage opening 50, and hence the container 30, from the outside. The link 79 assumes a right-angled position, as shown in FIG. 11, which leads to the shape of the cap shown in FIG. 1. The link section 80 joined to the casing 83 lies snug against the rear concave wall 91 of the casing 83, while the other two link sections 81, 82 form a right angle. The pre-tensioning force of the spring elements 58, 59 is virtually completely converted into a force closing the discharge sleeve 39 relative to the passage opening 50, and the sealing spike 44 relative to the ventilation valve 43. In the closed and open position of the upper cap part 34, the lower edges 65 of the side cheeks or walls 61, 62 therefore always lie at a small distance above the upper side of the top wall 49. The closed position of the upper cap part 34 is fixed in the direction of movement of the upper part by the lifting lugs 70, 71 engaging in the corresponding cut-outs 75 of the side cheeks or walls 61, 62 with play being created.

When pressure is exerted in the direction of opening x on the upper and/or rear side of the upper cap part 34 and its connecting link 79 with the lower cap part 32, the upper cap part 34 is lifted up because of the oblique end surfaces 69 of the lifting lugs 70, 71 and the corresponding rear oblique surfaces 68 of the cut-outs 75 of the side cheeks or walls 61, 62 increasingly up to the height of the lifting lugs 70, 71 counter to the spring pre-tension of the spring elements 58, 59. Consequently, both the discharge sleeve 39 and the sealing sleeve 38, as well as the dispensing opening 73 and the sealing spike 44, can be lifted from their seats and transferred via the edges of their conical seat surfaces into the position corresponding to the open position of the upper cap part 34. This is possible because the lifting lugs 70, 71, as can be seen in particular in FIG. 3, are situated, when seen in the longitudinal direction of the upper cap part 34, with their longitudinal centre exactly on a cross-sectional plane of the upper cap part 34 which lies in the centre between the axes of the sealing sleeve 38 and the discharge sleeve 39 or the sealing spike 44 and the valve spike 45, which are in turn each arranged in a cross-sectional plane of the upper cap part 34 with the sealing sleeve 38 and the discharge sleeve 39.

The backward and forward movement of the upper cap part 34 between the closed and open position is facilitated by the front sides of the lifting lugs 70, 71, as well as the rear oblique surface 68 of the side cheeks or walls 61, 62, being inclined. In the closed and open position, the upper cap part 34 engages in each case with a catch action. According to FIGS. 13 and 14, the open position of the upper cap part 34 is characterized in that the discharge sleeve 39 lies with its open edge under the pre-tension of the spring elements 58, 59 tight against the conical edge 89 of the passage opening 50. The dispensing opening 73 lies outside the casing 83 of the lower cap part 32 open at the bottom. The sealing sleeve 38 lies freely above the upper side of the top wall 49. The link 79 lies extended inside the side walls 56, 57 of the guide groove 53 in the lower cap part 32.

As shown in FIG. 14, in the open position of the upper cap part 34, the sealing spike 44 lies freely above the upper side of the top wall 49. Since the valve spike 45 is dimensioned shorter relative to the sealing spike 44, the edge of the hole of the diaphragm 95 is pressed and sealed tightly against the valve spike 45 when pressure is exerted on the flexible plastic container 30. When the pressure is removed from the container wall, air can flow into the container through the ventilation valve 43, the compressed container wall resuming its original shape. At the same time, FIG. 14 clearly shows that the rear oblique surface 68 lies against the corresponding front oblique end surface 69 of the lifting lugs 70, 71 and thus prevents the possibility of the upper cap part 34 being displaced automatically backwards towards its closed position. In fact, this closing movement is only possible when a sufficient force is exerted on the upper cap part 34 in the closing direction.

The above description of the open position of the upper cap part 34 makes it clear that the pretensioning force of the pre-tensioning device 55 alone serves to seal the discharge sleeve 39 relative to the passage opening 50, the lower edge 65 of the side cheeks or walls 61, 62 of the upper part again lying a small distance above the upper side of the top wall 49.

The above description shows that the cap according to the invention is also suitable as a child-safe cap for flexible containers containing a liquid which, when the container and its contents are handled improperly, might entail a risk to the user.

What is claimed is:

1. A flexible liquid container with a sliding closure cap comprising: a neck on said container defining and surrounding an opening of the container; a lower part on said cap for being mounted to said container neck over said opening; a top wall on said cap lower part defining a passage opening for the liquid in the container; a dip tube extending substantially to the base of the container and mounted to said cap lower part top wall around said passage opening; and an upper part on said cap which is provided with a closing member for the passage opening and which can move between a closed position and an open position; said top wall having a ventilation valve that includes a diaphragm defining a hole; said cap upper part having a lower side and a sealing spike protruding from said lower side for closing said diaphragm hole when said cap upper part is in said closed position; said cap upper part further having a valve spike that projects from said lower side of said cap upper part and that is generally parallel to, but shorter than, said sealing spike for interacting with said diaphragm hole when said cap upper part is in said open position; said diaphragm being movable away from said valve spike by pressure outside of said container to permit venting of air through said hole into said container when the container internal pressure is less than said outside pressure; said diaphragm being movable to seal against said valve spike when the container is squeezed to dispense the liquid; said cap upper part further having a discharge channel with an inlet opening; said cap also including a pre-tensioning device having means for pressing said discharge channel to seal said inlet opening closed against an upper side of said cap top wall when the cap upper part is in the closed position and for pressing said discharge channel against said cap top wall to establish sealed communication between said inlet opening and said passage opening of said top wall when said cap upper part is in the open position.

2. The container according to claim 1, wherein a lifting device is provided on the top wall of the lower part, by means of which the upper part can be lifted, counter to the action of the pre-tensioning device, from the top wall of the lower part, when it moves from the closed or open position into the open or closed position respectively.

3. The container according to claim 1 or 15, wherein the upper side of the top wall of the lower part defines a base of a guide groove which extends diametrically above the top wall, is limited by said side walls which are parallel to each other and in which the upper part is mounted so as to be capable of being displaced backwards and forwards between the closed and open position.

4. Container according to claim 1 or 2, wherein said pretensioning device includes side walls on said cap lower part and engaging spring elements on said cap upper part; each said side wall defining a longitudinal slot which is closed at each end, which has an upper edge, and which is adapted to receive one of said spring elements; each said spring element having an end for being guided along said upper edge of one of said slots; said cap upper part also defining a lower edge which is held by said pre-tensioning device so that it is spaced from said cap lower part when said cap upper part is in both the closed and open positions.

5. The container according to claim 4, wherein each spring element is designed in the shape of a ski, the ski ends engaging resiliently underneath the upper slot edge of the longitudinal slot in the side walls of the lower part.

6. The container according to claim 5, wherein the lifting device consists of lifting lugs which are arranged on the upper side of the top wall in the region of the path of movement of side walls of the upper part, the lower edge of the side walls of the upper part is provided with a cut-out which approximately corresponds to the longitudinal profile of the lifting lugs on the top wall of the lower part and determines the closed position of the upper part relative to the lower part by the engagement of each lifting lug into the associated cut-out in both side walls of the upper part and that the side walls, in the open position of the upper part, lie against an oblique end surface of the lifting lugs with a rear oblique surface.

7. The container according to claim 1 or 2, wherein the inlet opening is associated with a discharge sleeve which, in the direction of the opening movement of the upper part, at a small distance in front of a sealing sleeve, projects from the lower side of the upper part for the same length as the sealing sleeve parallel to the latter and engages with the inlet opening, in the closed position, into a recessed residualproduct, position, lies tightly against the edge of the passage lies tightly against the edge of the passage opening in the top wall.

8. The container according to claim 7, wherein the sealing sleeve, in the closed position of the upper part, lies sealingly against the edge of the passage opening in the lower part and, in the open position of the upper part, is arranged at a distance above the top wall of the lower part.

9. The container according to claim 7, wherein the discharge channel extends from the upper end of the discharge sleeve, radially to the latter and parallel to the axis of the top wall, towards its dispensing opening.

10. The container according to claim 9, wherein the discharge channel extends in a curve from the upper end of the discharge sleeve downwards to its dispensing opening which, in the closed position of the upper part, lies tightly against the upper side of the top wall of the lower part and, in the open position of the upper part, lies outside the top wall open at the bottom.

11. The container according to claim 10, wherein the top wall is integrally joined to the lower part at its end facing away from the dispensing opening via a link provided with several hinges.

12. The container according to claim 11, wherein the link consists of three link sections joined by the hinges, of which the link section articulated with the upper part, and the central link section, have a width corresponding to the upper part, while the third link section joined to the lower part is joined by a hinge to the casing of the lower part, the width of which is dimensioned substantially smaller than the width of the upper part.

13. The container according to claim 12, wherein the outer end of the third link section, which terminates in the hinge with the casing of the lower part, is rounded off with a radius which approximately corresponds to the radius of the casing of the lower part.

* * * * *